US010569140B2

(12) United States Patent
Shinohara et al.

(10) Patent No.: US 10,569,140 B2
(45) Date of Patent: Feb. 25, 2020

(54) GOLF BALL

(71) Applicant: Bridgestone Sports Co., Ltd., Minato-ku, Tokyo (JP)

(72) Inventors: Hirotaka Shinohara, Chichibushi (JP); Takashi Ohira, Chichibushi (JP)

(73) Assignee: Bridgestone Sports Co., Ltd., Minato-ku, Tokyo (JP)

( * ) Notice: Subject to any disclaimer, the term of this patent is extended or adjusted under 35 U.S.C. 154(b) by 0 days.

(21) Appl. No.: 16/004,630

(22) Filed: Jun. 11, 2018

(65) Prior Publication Data

US 2018/0369649 A1 Dec. 27, 2018

(30) Foreign Application Priority Data

Jun. 23, 2017 (JP) ..... 2017-122840

(51) Int. Cl.
*A63B 37/06* (2006.01)
*A63B 37/00* (2006.01)
*A63B 1/00* (2006.01)

(52) U.S. Cl.
CPC ..... *A63B 37/0022* (2013.01); *A63B 1/00* (2013.01); *A63B 37/005* (2013.01); *A63B 37/0023* (2013.01); *A63B 37/0038* (2013.01)

(58) Field of Classification Search
CPC ..... A63B 37/0022
USPC ..... 473/378
See application file for complete search history.

(56) References Cited

U.S. PATENT DOCUMENTS

| | | | | |
|---|---|---|---|---|
| 6,100,361 | A * | 8/2000 | Keller | C08G 18/7831 528/44 |
| 7,101,934 | B2 | 9/2006 | Shimura et al. | |
| 9,011,272 | B2 | 4/2015 | Isogawa et al. | |
| 2015/0182804 | A1* | 7/2015 | Tarao | A63B 37/0022 473/374 |
| 2015/0273276 | A1* | 10/2015 | Isogawa | C08G 18/10 473/374 |

FOREIGN PATENT DOCUMENTS

| | | | |
|---|---|---|---|
| JP | 2002-053799 | A | 2/2002 |
| JP | 2003-253201 | A | 9/2003 |
| JP | 2011-067595 | A | 4/2011 |

* cited by examiner

*Primary Examiner* — Raeann Gorden
(74) *Attorney, Agent, or Firm* — Sughrue Mion, PLLC

(57) ABSTRACT

In a golf ball having a core, a cover of at least one layer and a paint film layer formed on a surface of the cover, the paint film layer has an elastic work recovery of at least 60%, the cover layer in contact with the paint film layer has a material hardness on the Shore D scale of at least 55 and, letting M be the elastic work recovery (%) of the paint film layer and N be the material hardness (Shore D hardness) of the cover layer, M−N>0. The ball surface is scratch-resistant and has an excellent durability, and the ball has a reduced spin rate on shots with a driver or a long iron, resulting in an increased carry.

10 Claims, No Drawings

GOLF BALL

CROSS-REFERENCE TO RELATED APPLICATION

This non-provisional application claims priority under 35 U.S.C. § 119(a) on Patent Application No. 2017-122840 filed in Japan on Jun. 23, 2017, the entire contents of which are hereby incorporated by reference.

TECHNICAL FIELD

This invention relates to a golf ball having a core and a cover of at least one layer, which cover has a paint film layer formed on the surface thereof.

BACKGROUND ART

A paint composition is often applied onto the surface portion of a golf ball in order to protect the ball surface or to maintain an attractive appearance. Two-part curing polyurethane paints which are used by mixing together a polyol and a polyisocyanate just prior to painting are suitably employed as such golf ball paint compositions for a number of reasons, including their ability to withstand large deformation, impact and abrasion (see, for example, JP-A 2003-253201).

A frequent goal of recent golf ball development has been to further lower the spin rate on full shots taken with a driver. This move toward lower spin rates has engendered a trend toward greater hardness in the cover serving as the outermost layer of the ball.

Most golf balls have a core, a cover positioned outside of the core, and a paint film layer positioned outside of the cover. Making this paint film layer soft also often provides certain advantages, such as contributing to stability in the spin rate of the golf ball and imparting outstanding durability (see, for example, JP-A 2011-67595).

However, JP-A 2011-67595 does not take into account the scratch performance of the paint film layer. When a scratch forms in the paint film layer, the paint film has a tendency to peel from the affected area and the durability of the paint film may worsen. Also, the scratchability of the paint film on a golf ball is known to be affected by the underlying cover material; the higher the cover hardness, the greater the tendency for the scratch resistance to decrease and the paint film durability to worsen. What the golfer desires most in a golf ball is distance, and so, in many golf balls, properties such as the hardnesses and thicknesses of the core and cover are adjusted with increased distance as the primary aim. Golfers attach particular importance to the carry of the ball on shots taken with a driver. The carry of the ball on a driver shot correlates to the rebound performance of the golf ball; many golf balls in which the rebound performance has been increased by making use of a relatively hard cover are sold on the market. Therefore, in golf balls having a paint film layer, the relationship between the paint film layer and a hard cover layer is important. A major challenge has been how to not only improve the scratch performance and durability of the ball surface, but also deliver an excellent distance on shots with a driver and the like.

SUMMARY OF THE INVENTION

It is therefore an object of the present invention to provide a golf ball whose surface has an excellent scratch resistance and durability, and which has a reduced spin rate on shots with a driver or a long iron and thus an improved carry.

As a result of extensive investigations, we have discovered that, in a golf ball having a core, a cover of at least one layer and a paint film layer formed on a surface of the cover, by setting the elastic work recovery of the paint film layer to at least 60%, forming the cover layer in contact with the paint film layer of a resin material having a Shore D hardness of at least 55, and designing the golf ball such that, letting M be the elastic work recovery (%) of the paint film layer and N be the material hardness (Shore D hardness) of the cover layer, $M-N>0$, the combination of the paint film layer with the cover layer positioned on the inside thereof (outermost layer) is good and a reduced spin rate and a high rebound are achieved on driver shots, thereby increasing the carry of the ball. Moreover, the ball surface has an excellent scratch resistance and durability.

Accordingly, the invention provides a golf ball having a core, a cover of at least one layer encasing the core and a paint film layer formed on a surface of the cover, wherein the paint film layer has an elastic work recovery of at least 60%, the cover layer in contact with the paint film layer has a material hardness on the Shore D scale of at least 55 and, letting M be the elastic work recovery (%) of the paint film layer and N be the material hardness (Shore D hardness) of the cover layer, $M-N>0$.

The value $M-N$ is preferably 5 or more.

The paint film layer preferably has a thickness of at least 6 μm.

In a preferred embodiment of the golf ball of the invention, letting the thickness of the paint film layer be X (μm), $N-X^2<20$.

In another preferred embodiment of the inventive golf ball, the cover layer is formed primarily of an ionomer resin.

In yet another preferred embodiment, the paint film layer is formed primarily of two differing types of polyester polyol.

Advantageous Effects of the Invention

In the golf ball of the invention, even though the cover layer is formed using a relatively hard resin material, the ball surface is resistant to scratching and endowed with excellent durability. Moreover, the ball has a reduced spin rate on shots with a driver or a long iron, enabling the distance (carry) of the ball to be increased.

DESCRIPTION OF THE PREFERRED EMBODIMENTS

The objects, features and advantages of the invention will become more apparent from the following detailed description.

The golf ball of the invention has a core, a cover of at least one layer encasing the core, and a paint film layer formed on a surface of the cover. The cover used in this invention may be formed of one layer or may be formed as a plurality of layers, such as two, three or more layers. In this specification, each layer of the cover is called a "cover layer" and the cover layers are referred to collectively as the "cover."

The core may be formed using a known rubber material as the base material. A known base rubber such as a natural rubber or a synthetic rubber may be used as the base rubber. More specifically, the use of primarily polybutadiene, especially cis-1,4-polybutadiene having a cis structure content of at least 40%, is recommended. Where desired, a natural rubber, polyisoprene rubber, styrene-butadiene rubber or the like may be used in the base rubber together with the above polybutadiene. The polybutadiene may be synthesized with a titanium-based, cobalt-based, nickel-based or neodymium-based Ziegler catalyst or with a metal catalyst such as cobalt or nickel.

Co-crosslinking agents such as an unsaturated carboxylic acid or a metal salt thereof, inorganic fillers such as zinc oxide, barium sulfate or calcium carbonate, and organic peroxides such as dicumyl peroxide or 1,1-bis(t-butylperoxy)cyclohexane may be compounded with the base rubber. Where necessary, other ingredients such as commercial antioxidants may be suitably added.

The cover is exemplified by covers having at least one layer, including two-layer covers and three-layer covers. In the case of a two-layer cover, the cover layers are referred as the "intermediate layer" on the inside and the "outermost layer" on the outside. In the case of a three-layer cover, the cover layers are referred to as, in order from the inside, the "envelope layer," the "intermediate layer" and the "outermost layer." The outside surface of the outermost layer typically has numerous dimples formed thereon for the purpose of enhancing the aerodynamic properties.

The materials making up the cover layers are not particularly limited, although various thermoplastic resin materials can be suitably used. That is, the cover layers may be formed of, for example, ionomer resins, polyester resins, polyamide resins, and also polyurethane resins. In particular, the use of a highly neutralized resin mixed material or an ionomer resin material is suitable for obtaining, as subsequently described, a resin material that is relatively hard and has a high resilience.

Commercial products may be used as these resins. Illustrative examples include sodium-neutralized ionomer resins such as Himilan® 1605, Himilan® 1601 and AM 7318 (all products of DuPont-Mitsui Polychemicals Co., Ltd.) and Surlyn® 8120 (E.I. DuPont de Nemours & Co.); zinc-neutralized ionomer resins such as Himilan® 1557, Himilan® 1706 and AM 7317 (all products of DuPont-Mitsui Polychemicals Co., Ltd.); and the products available from E.I. DuPont de Nemours & Co. under the trade names HPF 1000, HPF 2000 and HPF AD1027, as well as the experimental material HPF SEP1264-3. These may be used singly or two or more may be used in combination.

The thickness of the cover layer, although not particularly limited, is preferably at least 0.5 mm, and more preferably at least 0.7 mm. The upper limit is preferably not more than 2.0 mm, more preferably not more than 1.5 mm, and even more preferably not more than 1.2 mm.

The Shore D hardness of the cover layer, although not particularly limited, is preferably at least 55, and more preferably at least 57. The upper limit may be set to preferably not more than 70, more preferably not more than 68, and even more preferably not more than 65.

In this invention, the cover layer in contact with the subsequently described paint film layer has a material hardness on the Shore D scale of at least 55. That is, in this invention, a relatively hard cover material is used in order to impart a high rebound and increase the carry of the golf ball on full shots with a driver or a long iron. Moreover, as subsequently described, by conferring a good interlaminar relationship with the paint film layer, an excellent paint film durability is imparted.

The material of the cover layer in contact with the paint film layer is similar in nature to the above-described cover layer material. However, to be able to achieve in particular both a high rebound and a reduced spin rate, it is suitable for this to be composed primarily of an ionomer resin.

A known method may be used without particular limitation as the method of forming the cover layer. For example, use may be made of a method in which a pre-fabricated core or a sphere composed of the core encased by a cover layer is placed in a mold, and the resin material prepared as described above is injection-molded over the core or layer-encased sphere.

Numerous dimples of one type or two or more types may be formed on the outer surface of the cover layer serving as the outermost layer of the cover.

A paint film layer is formed on the surface of the cover. This paint film layer can be formed by applying various types of paint. Because the paint film layer must be capable of enduring the harsh conditions of golf ball use, it is desirable to use a paint composition in which the chief component is a urethane paint composed of a polyol and a polyisocyanate.

The polyol component is exemplified by acrylic polyols and polyester polyols. These polyols include modified polyols. To further increase workability, other polyols may also be added.

Exemplary acrylic polyols include homopolymers and copolymers of monomers having functional groups that react with isocyanate. Such monomers include alkyl esters of (meth)acrylic acids, specific examples of which include methyl (meth)acrylate, ethyl (meth)acrylate, isopropyl (meth)acrylate, butyl (meth)acrylate, isobutyl (meth)acrylate, 2-ethylhexyl (meth)acrylate, lauryl (meth)acrylate, stearyl (meth)acrylate, cyclohexyl (meth)acrylate, isobornyl (meth)acrylate, 2-hydroxyethyl (meth)acrylate, 2-hydroxypropyl (meth)acrylate and 4-hydroxybutyl (meth)acrylate. These may be used singly, or two or more may be used together.

Modified acrylic polyols that may be used include polyester-modified acrylic polymers. Examples of other suitable polyols include polyether polyols such as polyoxyethylene glycol (PEG), polyoxypropylene glycol (PPG) and polyoxytetramethylene glycol (PTMG), conjugated polyester polyols such as polyethylene adipate (PEA), polybutylene adipate (PBA) and polyhexamethylene adipate (PH2A), and lactone-type polyester polyols such as poly-ε-caprolactone (PCL), and polycarbonate polyols such as polyhexamethylene carbonate. These may be used singly, or two or more may be used together. The ratio of these polyols to the total amount of acrylic polyol is preferably not more than 50 wt %, and more preferably not more than 40 wt %.

Polyester polyols are obtained by the polycondensation of a polyol with a polybasic acid. Examples of the polyol include diols such as ethylene glycol, 1,2-propanediol, 1,3-propanediol, 1,3-butanediol, 1,4-butanediol, 1,6-hexanediol, neopentyl glycol, diethylene glycol, dipropylene glycol, hexylene glycol, dimethylolheptane, polyethylene glycol and polypropylene glycol; and also triols, tetraols and polyols having an alicyclic structure. Examples of the polybasic acid include aliphatic dicarboxylic acids such as succinic acid, adipic acid, sebacic acid, azelaic acid and dimer acid; aliphatic unsaturated dicarboxylic acids such as fumaric acid, maleic acid, itaconic acid and citraconic acid; aromatic polycarboxylic acids such as phthalic acid, isophthalic acid, terephthalic acid, trimellitic acid and pyromellitic acid; dicarboxylic acids having an alicyclic structure, such as tetrahydrophthalic acid, hexahydrophthalic acid, 1,3-cyclohexanedicarboxylic acid, 1,4-cyclohexanedicarboxylic acid and endomethylene tetrahydrophthalic acid; and tris-2-carboxyethyl isocyanurate.

It is suitable to use two types of polyester polyols together as the polyol component. In this case, letting the two types of polyester polyol be component (A) and component (B), a polyester polyol in which a cyclic structure has been introduced onto the resin skeleton may be used as the polyester polyol of component (A). Examples include polyester polyols obtained by the polycondensation of a polyol having an alicyclic structure, such as cyclohexane dimethanol, with a polybasic acid; and polyester polyols obtained by the polycondensation of a polyol having an alicyclic structure with a diol or triol and a polybasic acid. A polyester polyol having a branched structure may be used as the polyester polyol of component (B). Examples include polyester polyols having a branched structure, such as NIPPOLAN 800, from Tosoh Corporation.

The weight-average molecular weight (Mw) of the overall base resin consisting of the above two types of polyester polyols is preferably from 13,000 to 23,000, and more preferably from 15,000 to 22,000. The number-average molecular weight (Mn) of the overall base resin consisting of the above two types of polyester polyols is preferably from 1,100 to 2,000, and more preferably from 1,300 to 1.850. Outside of these ranges in the average molecular weights (Mw and Mn), the wear resistance of the paint film layer may decrease. The weight-average molecular weight (Mw) and number-average molecular weight (Mn) are polystyrene-equivalent measured values obtained by gel permeation chromatography (GPC) using differential refractometry.

The contents of these two types of polyester polyol (A) and (B) are not particularly limited, although the content of component (A) is preferably from 20 to 30 wt % of the total amount of base resin and the content of component (B) is preferably from 2 to 18 wt % of the total amount of base resin.

The polyisocyanate is exemplified without particular limitation by commonly used aromatic, aliphatic, alicyclic and other polyisocyanates. Specific examples include tolylene diisocyanate, diphenylmethane diisocyanate, xylylene diisocyanate, tetramethylene diisocyanate, hexamethylene diisocyanate, lysine diisocyanate, isophorone diisocyanate, 1,4-cyclohexylene diisocyanate, naphthalene diisocyanate, trimethylhexamethylene diisocyanate, dicyclohexylmethane diisocyanate and 1-isocyanato-3,3,35-trimethyl-4-isocyanatomethylcyclohexane. These may be used singly or in admixture.

Modified hexamethylene diisocyanates include, for example, polyester-modified hexamethylene diisocyanate and urethane-modified hexamethylene diisocyanate. Derivatives of hexamethylene diisocyanate include isocyanurates, biurets and adducts of hexamethylene diisocyanate.

The molar ratio of isocyanate (NCO) groups on the polyisocyanate to hydroxyl (OH) groups on the polyol, expressed as NCO/OH, must be in the range of 0.5 to 1.5, and is preferably from 0.8 to 1.2, and more preferably from 1.0 to 1.2. At less than 0.5, unreacted hydroxyl groups remain, which may adversely affect the performance and water resistance of the paint film layer. On the other hand, at above 1.5, the number of isocyanate groups becomes excessive and urea groups (which are fragile) form in reactions with the moisture, as a result of which the paint film layer performance may decline.

An amine catalyst or an organometallic catalyst may be used as the curing catalyst (organometallic compound). Examples of such organometallic compounds include soaps of metals such as aluminum, nickel, zinc or tin. Preferred use can be made of those which have hitherto been formulated as curing agents for two-part curing urethane paints.

Depending on the painting conditions, various types of organic solvents may be mixed into the paint composition. Examples of such organic solvents include aromatic solvents such as toluene, xylene and ethylbenzene; ester solvents such as ethyl acetate, butyl acetate, propylene glycol methyl ether acetate and propylene glycol methyl ether propionate; ketone solvents such as acetone, methyl ethyl ketone, methyl isobutyl ketone and cyclohexanone; ether solvents such as diethylene glycol dimethyl ether, diethylene glycol diethyl ether and dipropylene glycol dimethyl ether; alicyclic hydrocarbon solvents such as cyclohexane, methyl cyclohexane and ethyl cyclohexane; and petroleum hydrocarbon solvents such as mineral spirits.

Known paint compounding ingredients may be optionally added to the paint composition. For example, thickeners, ultraviolet absorbers, fluorescent brighteners, slip agents and pigments may be included in suitable amounts.

The thickness of the paint film layer made of the paint composition, although not particularly limited, is typically from 5 to 40 μm, and preferably from 10 to 20 μm. As used herein, "paint film layer thickness" refers not to the paint film layer that forms within the dimples, but to the thickness of the paint film that forms on the ball surface in non-dimple areas (also referred to as "lands").

In this invention, the paint film layer composed of the paint composition has an elastic work recovery that must at least 60%, and is preferably at least 70% and more preferably at least 80%. At a paint film layer elastic work recovery in this range, the paint film layer has a high elasticity and so the self-recovery ability is high, resulting in an outstanding abrasion resistance. Moreover, various performance attributes of the golf balls coated with this paint composition can be improved. The method of measuring the elastic work recovery is described below.

The elastic work recovery is one parameter of the nanoindentation method for evaluating the physical properties of paint film layers, which is a nanohardness test method that controls the indentation load on a micro-newton (μN) order and tracks the indenter depth during indentation to a nanometer (nm) precision. In prior methods, only the size of the dent (plastic deformation) corresponding to the maximum load could be measured. However, in the nanoindentation method, the relationship between the indentation load and the indentation depth can be obtained by automated and continuous measurement. Hence, unlike in the past, there are no individual differences between observers when visually measuring deformation under an optical microscope, enabling the physical properties of the paint film layer to be evaluated to a high precision. Given that the paint film layer on the ball surface is strongly affected by the impact of drivers and various other clubs and thus has a not inconsiderable influence on the golf ball properties, measuring the paint film layer by the nanohardness test method and carrying out such measurement to a higher precision than in the past is a very effective method of evaluation.

When using the paint composition of the invention, a paint film layer can be formed on the surface of golf balls manufactured by a commonly known method, via the steps of preparing the paint composition at the time of application, applying the composition to the golf ball surface by a conventional painting operation, and drying. The painting method is not particularly limited. For example, suitable use can be made of spray painting, electrostatic painting or dipping.

This invention is also characterized in that, letting M be the elastic work recovery (%) of the paint film layer and N be the material hardness (Shore D hardness) of the cover layer, $M-N>0$. That is, by setting the elastic work recovery (%) of the paint film layer so as to be higher than the material hardness of the cover layer, the paint film wear resistance can be maintained even when the cover hardness is high. The $M-N$ value is preferably at least 5, and more preferably at least 10.

Also, letting X be the thickness of the paint film layer and N be the material hardness (Shore D hardness) of the cover layer in contact with the paint film layer, it is preferable for the following relationship to be satisfied: $N-X^2<20$. By specifying the relationship between the cover layer hardness and the paint film layer thickness in this way, a good paint film durability can be achieved. In this formula, the square of the paint film layer thickness ($X^2$) represents the paint film durability; the smaller the formula value (i.e., the lower the cover material hardness or the thicker the paint film layer), the better the paint film durability. The paint film layer thickness X refers not to the thickness of the paint film at the deepest places within the dimples, but rather to the thickness of the paint film formed on the lands. Because there is a slope at the interior of the dimples, the paint tends to sag and collect at the bottom of the dimples, and so the paint film thickness is not always uniform. Therefore, the thickness of the paint film formed on areas of the ball surface other than the dimples is used as the definition of the paint film thickness.

The deflection of the golf ball when subjected to a load, i.e., the deflection when the ball is compressed under a final load of 1,275 N (130 kgf) from an initial load of 98 N (10 kgf), has a lower limit of preferably at least 2.0 mm, and more preferably at least 2.5 mm, and an upper limit of preferably not more than 5.0 mm, and more preferably not more than 4.0 mm. When the ball deflection is too small, the feel at impact may worsen significantly, or the spin rate may rise excessively, as a result of which the desired distance may not be achieved. On the other hand, when the deflection is too large, a good initial velocity may not be obtained or the durability may markedly decline. The deflection of the golf ball under specific loading refers here to the deflection measured for a completed golf ball having a paint film layer formed on the surface of the cover (outermost layer).

Ball specifications such as the ball mass (weight) and diameter may be set as appropriate according to the Rules of Golf.

EXAMPLES

The following Synthesis Examples, Working Examples and Comparative Examples are provided to illustrate the invention, and are not intended to limit the scope thereof.

Working Examples 1 to 7, Comparative Examples 1 to 5

Rubber compositions for the golf ball cores in the respective examples were prepared as formulated in Table 1, following which they were molded and vulcanized at 155° C. for 15 minutes to produce 39.7 mm diameter cores.

TABLE 1

| Core formulations | Working Example | | | | | | | Comparative Example | | | | |
|---|---|---|---|---|---|---|---|---|---|---|---|---|
| (pbw) | 1 | 2 | 3 | 4 | 5 | 6 | 7 | 1 | 2 | 3 | 4 | 5 |
| Polybutadiene A | 80 | 80 | 80 | 80 | 80 | 80 | 80 | 80 | 80 | 80 | 80 | 80 |
| Polybutadiene B | 20 | 20 | 20 | 20 | 20 | 20 | 20 | 20 | 20 | 20 | 20 | 20 |
| Organic peroxide | 1.0 | 1.0 | 1.0 | 1.0 | 1.0 | 1.0 | 1.0 | 1.0 | 1.0 | 1.0 | 1.0 | 1.0 |
| Barium sulfate | 16.0 | 16.0 | 15.3 | 15.3 | 14.8 | 14.5 | 14.5 | 16.0 | 15.3 | 14.0 | 14.0 | 14.0 |
| Zinc oxide | 4.0 | 4.0 | 4.0 | 4.0 | 4.0 | 4.0 | 4.0 | 4.0 | 4.0 | 4.0 | 4.0 | 4.0 |
| Zinc acrylate | 30.0 | 30.0 | 31.6 | 31.6 | 32.5 | 33.2 | 33.2 | 30.0 | 31.6 | 34.6 | 34.6 | 34.6 |
| Water | 1.0 | 1.0 | 1.0 | 1.0 | 1.0 | 1.0 | 1.0 | 1.0 | 1.0 | 1.0 | 1.0 | 1.0 |
| Zinc salt of pentachlorothiophenol | 0.3 | 0.3 | 0.3 | 0.3 | 0.3 | 0.3 | 0.3 | 0.3 | 0.3 | 0.3 | 0.3 | 0.3 |

Details on the above core materials are given below. Numbers in the table indicate parts by weight.

Polybutadiene A: Available under the trade name "BR01" from JSR Corporation.

Polybutadiene B: Available under the trade name "BR51" from JSR Corporation.

Organic peroxide: Dicumyl peroxide, available under the trade name "Percumyl D" from NOF Corporation Barium sulfate: Available under the trade name "Barico #100" from Hakusui Tech Zinc oxide: Available under the trade name "Zinc Oxide Grade 3" from Sakai Chemical Co., Ltd.

Zinc acrylate: Available from Nippon Shokubai Co., Ltd.

Water: Distilled water, available from Wako Pure Chemical Industries, Ltd.

Zinc salt of pentachlorothiophenol: Available from Wako Pure Chemical Industries, Ltd.

Next, a single-layer cover having a thickness of 1.5 mm formulated from the resin materials shown in Table 2 below was injection-molded over the core, thereby producing a two-piece solid golf ball. When injection molding was carried out, numerous dimples were formed on the outer surface of the cover at the same time.

TABLE 2

| Resin material (pbw) | I | II | III | IV | V |
|---|---|---|---|---|---|
| Himilan ® 1557 | 37.5 | 32.5 | 50 | 43.8 | |
| Himilan ® 1601 | 37.5 | 32.5 | 50 | 43.8 | |
| Himilan ® AM7318 | | | | | 85 |
| Himilan ® AM7327 | | | | | 15 |
| Nucrel ® AN4319 | 25.0 | 35.0 | | 12.4 | |
| Titanium oxide | 3.0 | 3.0 | 3.0 | 3.0 | |
| Magnesium stearate | 1.0 | 1.0 | 1.0 | 1.0 | |

Details on the cover materials are provided below. Numbers in the table indicate parts by weight.

Himilan® 1557, Himilan® 1601:

Ionomers available from DuPont-Mitsui Polychemicals Co., Ltd.

AM7318, AM7327: Ionomers available from DuPont-Mitsui Polychemicals Co., Ltd.

AN4319: An unneutralized ethylene-methacrylic acid-acrylic acid ester terpolymer available under the trade name Nucrel® from DuPont-Mitsui Polychemicals Co., Ltd.

Titanium oxide: Available as "R-550" from Ishihara Sangyo K.K.

Magnesium stearate: Available as "Magnesium Stearate G" from NOF Corporation

Formation of Paint Film Layer

Next, the paints formulated as shown in Tables 3 and 4 were coated with an air spray gun onto the surface of the cover layer on which numerous dimples had been formed. A paint film layer was formed in such a way that the thickness of the paint film layer formed on areas of the ball surface other than the dimples (i.e., the lands) was the thickness indicated for the respective examples shown in Table 5, thereby producing golf balls in each example.

Elastic Work Recovery

The elastic work recovery of the paint was measured using a paint film sheet having a thickness of 50 μm. The ENT-2100 nanohardness tester from Erionix Inc. was used as the measurement apparatus, and the measurement conditions were as follows.

Indenter: Berkovich indenter (material: diamond; angle α: 65.03°)

Load F: 0.2 mN

Loading time: 10 seconds

Holding time: 1 second

Unloading time: 10 seconds

The elastic work recovery was calculated as follows, based on the indentation work $W_{elast}$ (Nm) due to spring-back deformation of the paint film and on the mechanical indentation work $W_{total}$ (Nm).

$$\text{Elastic work recovery}=W_{elast}/W_{total}\times 100(\%)$$

TABLE 3

| | | | No. 1 | No. 2 | No. 3 | No. 4 |
|---|---|---|---|---|---|---|
| Paint formulation (pbw) | Base resin | Polyester polyol (A) | 23 | 25 | 26 | 27.5 |
| | | Polyester polyol (B) | 15 | 8 | 4 | |
| | | Organic solvent | 62 | 67 | 70 | 72.5 |
| | Curing agent | Isocyanurate of HMDI | 42 | 42 | 42 | 42 |
| | | Organic solvent | 58 | 58 | 58 | 58 |
| | Molar compounding ratio (NCO/OH) | | 0.89 | 0.74 | 0.65 | 0.57 |
| | Elastic work recovery (%) | | 84 | 80 | 77 | 62 |

TABLE 4

| | | | No. 5 |
|---|---|---|---|
| Paint formulation (pbw) | Base resin | Acrylic polyol | 100.0 |
| | | Ethyl acetate | 100.0 |
| | | Propylene glycol monomethyl ether acetate | 40.0 |
| | | Curing catalyst | 0.03 |
| | Curing agent | Isocyanurate of HMDI (1) | 25.9 |
| | | Polyester-modified HMDI (2) | 65.0 |
| | | Ethyl acetate | 29.1 |
| | Molar compounding ratio (NCO/OH) | | 1.08 |
| Elastic work recovery (%) | | | 25.5 |

NCO molar ratio: Isocyanurate of HMDI (1):Polyester-modified HMDI (2) = 0.67:0.41

Polyester Polyol (A) Synthesis Example

A reactor equipped with a reflux condenser, a dropping funnel, a gas inlet and a thermometer was charged with 140 parts by weight of trimethylolpropane, 95 parts by weight of ethylene glycol, 157 parts by weight of adipic acid and 58 parts by weight of 1,4-cyclohexanedimethanol, following which the temperature was raised to from 200 to 240° C. under stirring and the reaction was effected by continued heating and stirring for 5 hours. This yielded Polyester Polyol (A) having an acid value of 4, a hydroxyl value of 170 and a weight-average molecular weight (Mw) of 28,000.

Next, the Polyester Polyol (A) synthesized above was dissolved in butyl acetate, thereby preparing a varnish having a nonvolatile content of 70 wt %.

For Paint Formulation No. 1, the base resin was prepared by mixing 15 parts by weight of Polyester Polyol (B) (a saturated aliphatic polyester polyol available as "NIPPOLAN 800" from Tosoh Corporation; weight-average molecular weight (Mw), 1,000; 100% solids) and an organic solvent with 23 parts by weight of the above Polyester Polyol (A) solution. The resulting mixture had a nonvolatile content of 38.0 wt %.

For Paint Formulation No. 2, the base resin was prepared by mixing 8 parts by weight of Polyester Polyol (B) ("NIPPOLAN 800" from Tosoh Corporation; 100% solids) and an organic solvent with 25 parts by weight of the above Polyester Polyol (A) solution. The resulting mixture had a nonvolatile content of 33.0 wt %.

For Paint Formulation No. 3, the base resin was prepared by mixing 4 parts by weight of Polyester Polyol (B) ("NIPPOLAN 800" from Tosoh Corporation; 100% solids) and an organic solvent with 26 parts by weight of the above Polyester Polyol (A) solution. The resulting mixture had a nonvolatile content of 30.0 wt %.

For Paint Formulation No. 4, in Comparative Example 1, a base resin was prepared by, as shown in Table 1, dissolving Polyester Polyol (A) alone in butyl acetate without mixing in the above Polyester Polyol (B). The resulting solution had a nonvolatile content of 27.5 wt %.

Next, the isocyanurate shown in Table 3 was dissolved in an organic solvent and used as the curing agent for Paint Formulations No. 1 to 4. The paints of Paint Formulations No. 1 to 4 were prepared by adding together the isocyanurate of HMDI (Duranate™ TPA-100 from Asahi Kasei Corporation; NCO content, 23.1%; 100% nonvolatiles) and, as organic solvents, ethyl acetate and butyl acetate, in the proportions shown in Table 3.

With regard to Paint Formulation No. 5, a paint composition was used in which, as shown in Table 4 below, the polyol component in the base resin is an acrylic polyol.

Acrylic Polyol Synthesis Example

A reactor equipped with a stirrer, a thermometer, a condenser, a nitrogen gas inlet and a dropping device was charged with 1,000 parts by weight of butyl acetate and the temperature was raised to 100° C. under stirring. Next, a mixture consisting of 220 parts by weight of polyester-containing acrylic monomer (Placcel® FM-3, from Daicel Chemical Industries, Ltd.), 610 parts by weight of methyl methacrylate, 170 parts by weight of 2-hydroxyethyl methacrylate and 30 parts by weight of 2,2'-azobisisobutyronitrile was added dropwise over 4 hours. After the end of dropwise addition, the reaction was effected for 6 hours at the same temperature. Following reaction completion, 180 parts by weight of butyl acetate and 150 parts by weight of polycaprolactone diol (Placcel L205AL, from Daicel Chemical Industries, Ltd.) were charged and mixed in, giving a clear acrylic polyol resin solution having a solids content of 50%, a viscosity of 100 mPa·s (25° C.), a weight-average molecular weight of 10,000 and a hydroxyl value of 113 mgKOH/g (solids).

The cover and paint compositions in Working Examples 1 to 7 and Comparative Examples 1 to 5 were constituted as shown in Table 5 below. The golf balls in each example were evaluated according to the criteria shown below for the material hardness of the cover layer, ball deflection, flight performance, scratching of the ball surface following a sand abrasion test, and durability of the paint film. The results are shown in Table 5.

Material Hardness of Cover Layer

The cover layer-forming resin materials were molded into a sheet having a thickness of 2 mm and left to stand for at least two weeks, following which the Shore D hardness was measured in accordance with ASTM D2240-95.

Ball Deflection

The golf ball was placed on a hard plate and the amount of deflection when compressed under a final load of 1,275 N (130 kgf) from an initial load of 98 N (10 kgf) was measured. The amount of deflection here refers to the measured value obtained after holding the specimen isothermally at 23.9° C.

Flight Performance (W #1 Shots)

A driver (W #1) was mounted on a golf swing robot, and the distance (carry) of the ball when struck at a head speed (HS) of 46 m/s was measured. The club used was a TourStage X-Drive 415 (loft angle, 10.5°) manufactured by Bridgestone Sports Co., Ltd. In addition, the amount of spin by the ball immediately after being similarly struck was measured using an apparatus for measuring the initial conditions.

Evaluation of Ball Surface Appearance after Sand Abrasion Test

A pot mill with an outside diameter of 210 mm was charged with about 4 kg of sand having a size of about 5 mm, and 15 golf balls were placed in the mill. The balls were agitated in the mill at a speed of about 50 to 60 rpm for 120 minutes, following which the balls were removed from the mill and the appearance of each ball was rated according to the following criteria.

Rating Criteria

Exc: Ball surface is free of conspicuous scratches, blemishes, etc.

Good: Minor scratches and blemishes are visible on ball surface

Fair: Moderate degree of scratches and blemishes are visible on ball surface

NG: Large scratches due to abrasion, or blemishes and diminished gloss are conspicuous on ball surface Evaluation of Paint Film Durability A pot mill with an outside diameter of 210 mm was charged with about 1.7 L of sand having a size of about 5 mm and 1.7 L of water, and 15 golf balls were placed in the mill. The balls were agitated in the mill at a speed of about 50 to 60 rpm for 120 minutes, following which the balls were removed from the mill and peeling of the paint film was rated according to the following criteria.

Rating Criteria

Exc: Peeled area on ball surface is less than 60 $mm^2$

Good: Peeled area on ball surface is from 60 to 119 $mm^2$

Fair: Peeled area on ball surface is from 120 to 499 $mm^2$

NG: Peeled area on ball surface is 500 $mm^2$ or more

TABLE 5

| | | | Working Example | | | | | | | Comparative Example | | | | |
|---|---|---|---|---|---|---|---|---|---|---|---|---|---|---|
| | | | 1 | 2 | 3 | 4 | 5 | 6 | 7 | 1 | 2 | 3 | 4 | 5 |
| Cover | Material | | V | V | III | III | IV | I | I | V | III | II | II | II |
| | Material hardness (Shore D) | | 65 | 65 | 60 | 60 | 57.5 | 56 | 56 | 65 | 60 | 54 | 54 | 54 |
| Paint film layer | Paint composition | | No. 1 | No. 2 | No. 3 | No. 4 | No. 4 | No. 4 | No. 4 | No. 4 | No. 5 | No. 4 | No. 5 | No. 4 |
| | Elastic work recovery (%) | | 84 | 80 | 77 | 62 | 62 | 62 | 62 | 62 | 25.5 | 62 | 25.5 | 62 |
| | Formula: M-N | | 19 | 15 | 17 | 2 | 4.5 | 6 | 6 | −3 | −34 | 8 | −28 | 8 |
| | Film thickness at lands (μm) | | 7.0 | 7.0 | 7.0 | 7.0 | 7.0 | 8.0 | 7.0 | 7.0 | 5.0 | 7.0 | 5.0 | 5.0 |
| | Formula: $N-X^2$ | | 16.0 | 16.0 | 11.0 | 11.0 | 8.5 | −8.0 | 7.0 | 16.0 | 35.0 | 5.0 | 29.0 | 29.0 |
| Ball properties | Deflection (mm) | | 3.3 | 3.3 | 3.3 | 3.3 | 3.3 | 3.3 | 3.3 | 3.3 | 3.3 | 3.3 | 3.3 | 3.3 |
| | Flight Performance (W#1) | Spin rate (rpm) | 2,750 | 2,750 | 2,780 | 2,780 | 2,800 | 2,810 | 2,810 | 2,750 | 2,790 | 2,850 | 2,850 | 2,850 |
| | | Carry (m) | 227 | 227 | 225 | 225 | 225 | 225 | 225 | 227 | 225 | 224 | 224 | 224 |
| | Ball surface (scratchability) | | Exc | Exc | Exc | Good | Good | Good | Good | Fair | NG | Good | NG | Fair |
| | Paint film durability | | Good | Good | Good | Good | Good | Exc | Good | Good | NG | Good | Fair | Fair |

*In the above formulas, M, N and X represent, respectively, the elastic work recovery (%), the Shore D hardness of the cover material, and the paint film layer thickness (μm).

The results in Table 5 demonstrate the following about Comparative Examples 1 to 5.

In Comparative Example 1, the elastic recovery was too low with respect to the cover hardness, and so the scratch performance was unsatisfactory.

In Comparative Example 2, the elastic recovery was too low with respect to the cover hardness, and so the scratch performance was unsatisfactory. In addition, the film thickness was low with respect to the cover hardness, and so the paint film durability was also unsatisfactory.

In Comparative Example 3, the cover hardness was too low, and so a suitable spin rate could not be obtained, resulting in a poor carry.

In Comparative Example 4, the elastic recovery was too low with respect to the cover hardness, and so the scratch performance was unsatisfactory. In addition, the film thickness was low with respect to the cover hardness, and so the paint film durability was also unsatisfactory.

In Comparative Example 5, the cover hardness was too low, resulting in a poor carry. In addition, the film thickness was low with respect to the cover hardness, and so the paint film durability was also unsatisfactory.

Japanese Patent Application No. 2017-122840 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising a core, a cover of at least one layer encasing the core and a paint film layer formed on a surface of the cover, wherein the paint film layer has an elastic work recovery of at least 60%, the cover layer in contact with the paint film layer has a material hardness on the Shore D scale of at least 55 and, letting M be the elastic work recovery (%) of the paint film layer and N be the material hardness (Shore D hardness) of the cover layer, $M-N>0$, and wherein the paint film layer is a urethane paint composed of a polyol and a polyisocyanate, and the polyol consists of two types of a polyester polyol, the two types of polyester polyol being a polyester polyol component (A) having a cyclic structure and a polyester polyol component (B) having a branched structure.

2. The golf ball of claim 1, wherein the value $M-N$ is 5 or more.

3. The golf ball of claim 1, wherein the paint film layer has a thickness of at least 6 μm.

4. The golf ball of claim 1 wherein, letting the thickness of the paint film layer be X (μm), $N-X^2<20$.

5. The golf ball of claim 1, wherein the cover layer is formed primarily of an ionomer resin.

6. The golf ball of claim 1, wherein a base resin consists of the two types of polyester polyols (A), (B) and an organic solvent, the content of polyol component (A) is from 20 to 30 wt % of the total amount of the base resin and the content of polyol component (B) is from 2 to 18 wt % of the total amount of the base resin.

7. The golf ball of claim 1, wherein the weight-average molecular weight (Mw) of the two types of polyester polyols is from 13,000 to 23,000.

8. The golf ball of claim 1, wherein the number-average molecular weight (Mn) of the two types of polyester polyols is from 1,100 to 2,000.

9. The golf ball of claim 1, wherein the polyester polyol component (A) having a cyclic structure is a polyester polyol obtained by the polycondensation of a polyol having an alicyclic structure with a polybasic acid.

10. The golf ball of claim 1, wherein the polyester polyol component (A) having a cyclic structure is a polyester polyol obtained by the polycondensation of a polyol having an alicyclic structure with a diol or triol and a polybasic acid.

* * * * *